US006155787A

United States Patent [19]

Hodgkins, Jr.

[11] Patent Number: 6,155,787

[45] Date of Patent: Dec. 5, 2000

[54] INTERCHANGEABLE FAN BLADE SYSTEM

[76] Inventor: Donald P. Hodgkins, Jr., 10 A Pine Isle Dr., Derry, N.H. 03038

[21] Appl. No.: 09/363,832

[22] Filed: Jul. 30, 1999

Related U.S. Application Data

[62] Division of application No. 08/955,487, Oct. 22, 1997, Pat. No. 5,944,486.

[60] Provisional application No. 60/042,381, Apr. 24, 1997.

[51] Int. Cl.[7] ..... F01D 5/30

[52] U.S. Cl. ..... 416/210 R; 416/220 R

[58] Field of Search ..... 416/206, 210 R, 416/205, 214 R, 204 R, 207, 6, 220 R; 411/172, 32, 539, 173, 174, 33, 175, 178, 354; 403/3, 14, 4

[56] References Cited

U.S. PATENT DOCUMENTS

| | | | |
|---|---|---|---|
| D. 256,614 | 8/1980 | Hoyt . | |
| D. 336,513 | 6/1993 | Junkin et al. . | |
| D. 361,124 | 8/1995 | Pearce . | |
| 1,033,677 | 7/1912 | Day | 411/345 |
| 2,318,548 | 5/1943 | Whitehead et al. | 411/345 |
| 4,439,078 | 3/1984 | Dessouroux | 411/178 |
| 4,936,751 | 6/1990 | Marshall | 416/5 |
| 5,097,771 | 3/1992 | James, III | 108/42 |
| 5,116,242 | 5/1992 | Scotti | 439/538 |
| 5,458,464 | 10/1995 | Lee . | |
| 5,462,412 | 10/1995 | Scofield et al. | 416/210 R |
| 5,470,205 | 11/1995 | Conklin, Jr. . | |
| 5,486,094 | 1/1996 | Davis, Jr. et al. . | |
| 5,489,162 | 2/1996 | LoCicero | 403/331 |
| 5,653,349 | 8/1997 | Dana et al. | 211/189 |
| 5,722,814 | 3/1998 | Yu | 416/204 R |

*Primary Examiner*—Edward K. Look
*Assistant Examiner*—James M McAleenan
*Attorney, Agent, or Firm*—Richard C. Litman

[57] ABSTRACT

An interchangeable fan blade system for a ceiling fan, made up of a set of adapters having a plurality of elongated attachment apertures that allow the adapter to be threadably fitted to virtually any type of fan support arm, and a complimentary set of interchangeable fan blades. The adapters include one of a variety of connectors for attaching one end of the fan blades to the support arm. The one end of the fan blade is configured and adapted, or otherwise provided with mating connector elements adapted to engage the connectors of the adapters, thereby allowing the fan blades to be removably attached to the adapters. A second embodiment of the interchangeable fan blade system is a set of interchangeable fan blades having a plurality of elongated attachment apertures which allow the fan blades to be secured to virtually any type of fan arm, by threading a plurality of shoulder cap screws and a plurality of male-female connectors though the plurality of attachment apertures. A third embodiment of the interchangeable fan blade system is a set of support arms attached to the rotating portion of the fan and having one of a variety of connectors for removably attaching one end of the fan blades to the support arm.

3 Claims, 9 Drawing Sheets

INTERCHANGEABLE FAN BLADE SYSTEM

CROSS-REFERENCE TO RELATED APPLICATION

This application is a division of application Ser. No. 08/955,487 filed Oct. 22, 1997, which claims the benefit of U.S. Provisional Patent Application Ser. No. 60/042,381, filed Apr. 24, 1997.

BACKGROUND OF THE INVENTION

1. Field of the Invention

The present invention relates to ceiling fans, and more particularly to interchangeable decorative ceiling fan blades and an adapter for easy attachment and replacement of the blades on a ceiling fan.

2. Description of Related Art

Given the high energy cost of air conditioning, individuals have increasingly sought to reduce such costs by installing ceiling fans to provide air circulation at a much more modest cost than air conditioning. However, ceiling fans are often unsightly eyesores, and are difficult and dangerous to clean. Furthermore, in strong winds such as a hurricane, ceiling fan blades act as sails which can damage the fan and possibly injure people and destroy property.

Typically, fan blades are bland in character in an attempt by the manufacturer to match every possible decor. Nevertheless, individuals have attempted to install decorative ceiling fans and blades to liven their surroundings. Replacement fan blades are available, but selection is extremely limited. Should an individual desire to replace fan blades, the holes of the replacement blades must match the hole arrangement of the support arms of the fan. Therefore, many types of blades are needed just to provide replacements for the different fans. While custom manufacture of blades is an option, it is prohibitively expensive for most users.

Decorative ceiling fans and decorative component parts are well known in the prior art. One such ceiling fan is shown in U.S. Pat. No. Des. 256,614 which issued to Hoyt on Aug. 26, 1980, and discloses a combined ceiling fan cover plate and blade connectors which have a leaf-like appearance.

Another similar invention is disclosed in U.S. Pat. No. Des. 361,124 which issued to Pearce on Aug. 8, 1995. The invention disclosed is a ceiling fan with blades in the shape of an airplane propeller, with a decorative decal of a fighter plane which attaches to a ceiling, giving the appearance of an airplane dive-bombing in the room. Additionally, U.S. Pat. No. Des. 336,513 which issued to Junkin et al. on Jun. 15, 1993 discloses a ceiling fan blade that comprises fabric suspended by a tubular frame.

U.S. Pat. No. 5,458,464 which issued to Lee on Oct. 17, 1995, discloses a blade mounting device for a ceiling fan. The device comprises a plurality of brackets, with a plurality of decorative inserts which have various configurations, profiles and colors. Only the inserts themselves are interchangeable, and the fan blades still require a significant amount of labor to remove.

U.S. Pat. No. 5,470,205 which issued to Conklin, Jr. on Nov. 28, 1995, discloses a decorative ceiling fan blade removably mounted on a ceiling fan. A decorative sheet may be applied to an adhesive layer on the underside of the blade. Additionally, the blade has a plurality of openings positioned in three groupings, in order to accommodate a variety of threaded openings on a fan support arm.

U.S. Pat. No. 5,486,094 which issued to Davis, Jr. et al. on Jan. 23, 1996, discloses a ceiling fan blade mounting bracket and support arms providing two fan blade support points, for reinforcing mounting of fan blades to the motor. These brackets do not provide for the easy removal of fan blades.

None of the above inventions and patents, taken either singly or in combination, is seen to describe the instant invention as claimed. Thus, an interchangeable fan blade system is desired to overcome the aforementioned shortcomings of the prior art.

SUMMARY OF THE INVENTION

The present invention provides an interchangeable fan blade system for a ceiling fan. A set of adapters have a plurality of elongated attachment apertures that allow the adapter to be fitted onto virtually any type of fan support arm with the use of a set of shoulder screws. The adapter may be formed into any of a variety of configurations. The system further includes a complimentary set of interchangeable fan blades having a set of keyhole bores, with each blade being configured to accept the shoulder screws of the adapter. Each blade may be removably secured to a respective adapter by a variety of fasteners, including but not limited to hooks, locator pin and hold downs, snap buckles, hook arms, spring clips, quick release pins, snap-ins, and hook-and-loop fasteners.

A second embodiment of the interchangeable fan blade system includes a set of interchangeable fan blades having a plurality of elongated attachment apertures which allow the blades to be secured to virtually any type of fan arm, by threading a plurality of shoulder cap screws and a plurality of male-female connectors though the plurality of elongated attachment apertures. The fan blade may be secured to the fan arm by either a knurled-knob screw with an elongated threaded portion, or a spring-clamp screw.

A third embodiment of the interchangeable fan blade system includes a set of support arms that have shoulder screws adapted to removably attach to a set of keyhole bores of a complimentary set of interchangeable fan blades. Each blade may be removably secured to a respective support arm by a variety of fasteners, including but not limited to hooks, locator pin and hold downs, snap buckles, hook arms, spring clips, quick release pins, snap-ins, and hook-and-loop fasteners.

Accordingly, it is a principal object of the invention to provide an interchangeable fan blade system that allows for easy replacement of fan blades with other fan blades of differing styles.

It is another object of the invention to provide an interchangeable fan blade system whereby fan blades may be easily removed for cleaning and maintenance.

It is a further object of the invention to provide an interchangeable fan blade system whereby fan blades may be easily removed in the event of inclement weather.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
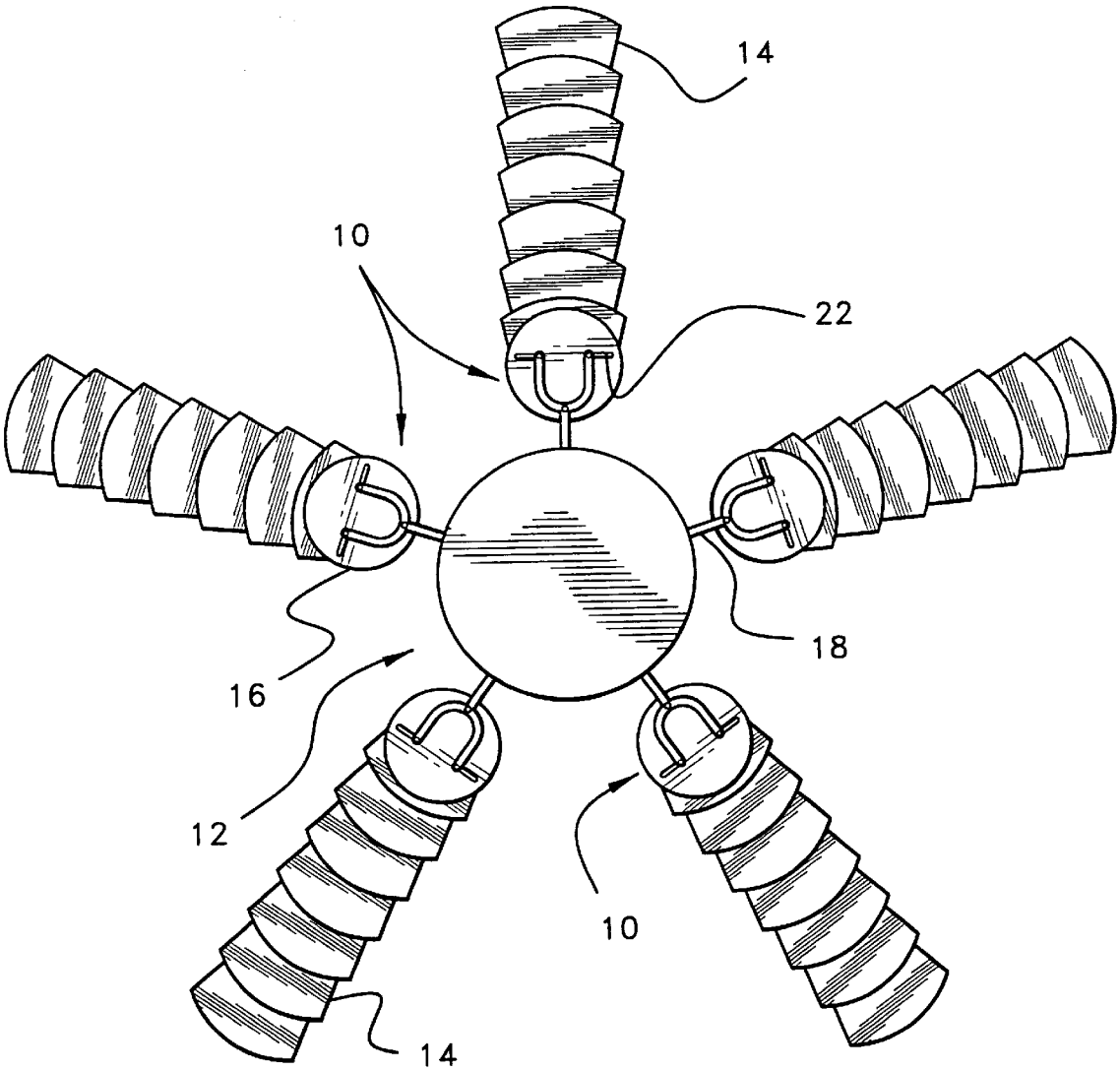
FIG. 1 is a plan view of a first embodiment of the interchangeable fan blade system of the present invention shown in use on a conventional ceiling fan.

Referring now to the drawings wherein like numerals represent like elements, FIG. 1 is a plan view of the interchangeable fan blade system 10 in use on a conventional ceiling fan 12, in accordance with a first embodiment of the invention. The system 10 includes a fan blade 14 and an adapter 16. The adapter 16 enables variety of different fan blades 14 to fit virtually any type of ceiling fan 12. Fan blades typically attach to the ceiling fan 121 by mounting the blades upon support arms 18 which are rotated by the fan motor (not shown). A conventional support arm 18 has a forked end that receives a fan blade by way of plurality of internally threaded cavities 24, each of which is adapted to receive one of a plurality of threaded screws 20. In ceiling fans 12 of the prior art, threaded screws 20 would pass through fan blade holes that align in registry with the threaded cavities 24 of the support arm 18. The screws 20 would then be fitted into the threaded cavities of the support arm 18, thereby securing the fan blade to the support arm.

Figure 2:
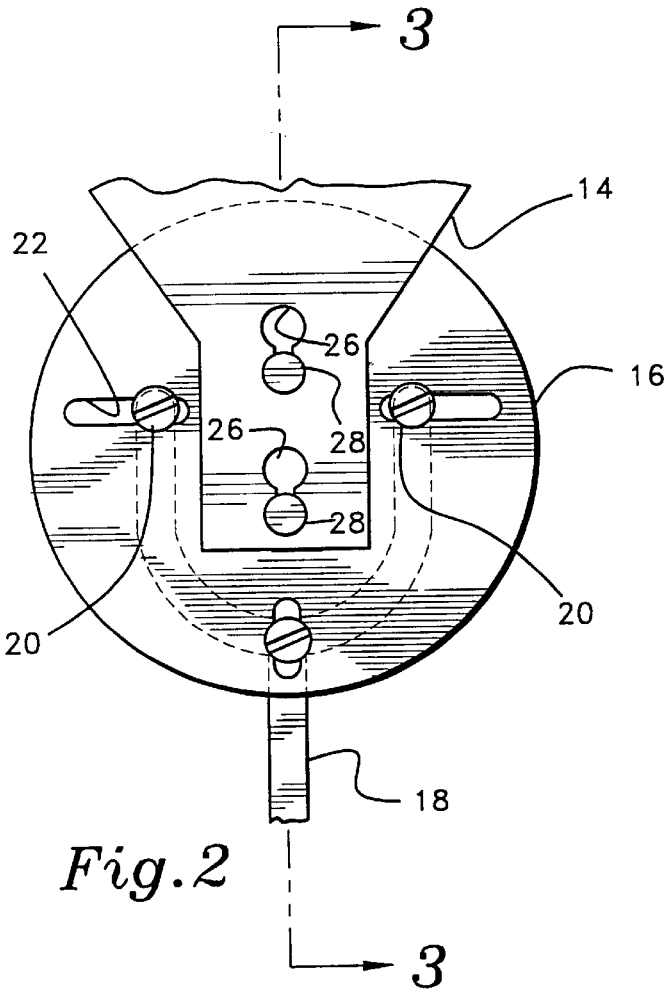
FIG. 2 is a plan view of the adapter of the first embodiment shown attached to a fan support arm.
Figure 4:
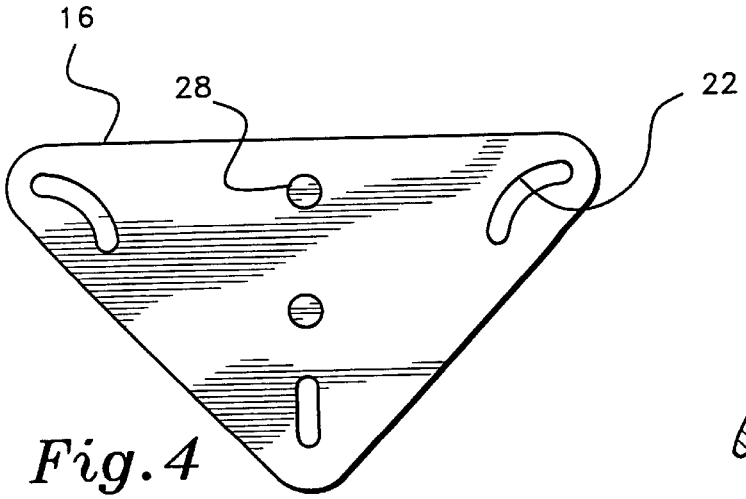
FIG. 4 is a plan view of an alternative adapter.
Figure 3:
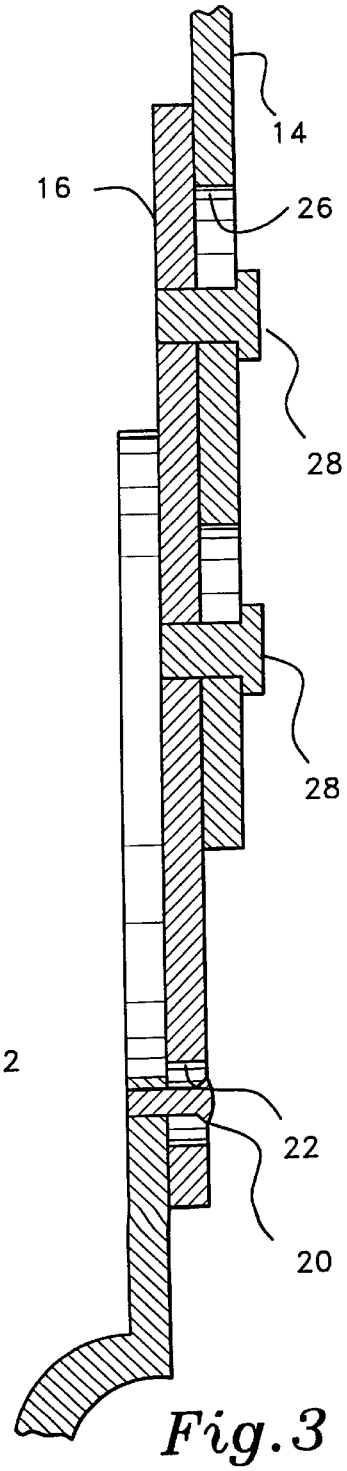
FIG. 3 is a sectional view along lines 3—3 of FIG. 2.

Referring now to FIGS. 2 and 3, the adapter 16 of the present invention has an arrangement of elongated attachment apertures 22 that align with the threaded cavities 24 of the support arm 18. The screws 20 are threadably fitted to the threaded cavities of the support arm 18, thereby allowing the adapter to be secured to a fan support arm 18 of virtually any size. FIG. 4 shows an alternative configuration for the adapter 16 of the present invention.

With the adapter 16 installed upon the support arm, various fan blades 14 may be removably secured to the adapter 16. The fan blade attaches to the adapter without use of tools. This allows a user to easily remove and replace fan blades 14 when changing or cleaning the fan blades. FIGS. 2 and 3 illustrate one method of securing the blade 14 to the adapter 16. A plurality of keyhole bores 26 are present on the proximal end of the blade 14, and a complimentary plurality of shoulder screws 28 are affixed to the upper surface of the adapter. To removably secure the fan blade 14 to the adapter 16, the keyhole bores 26 are first aligned in registry with and inserted over the shoulder screws 28. The fan blade 14 is then pulled outwardly away from the adapter 16, thereby securing the blade in place. Centrifugal force of the rotating fan 12 maintains the blade 14 in this secured position. The adapter 16 of FIG. 4 also employs shoulder screws 28 as fasteners.

Figure 5A:
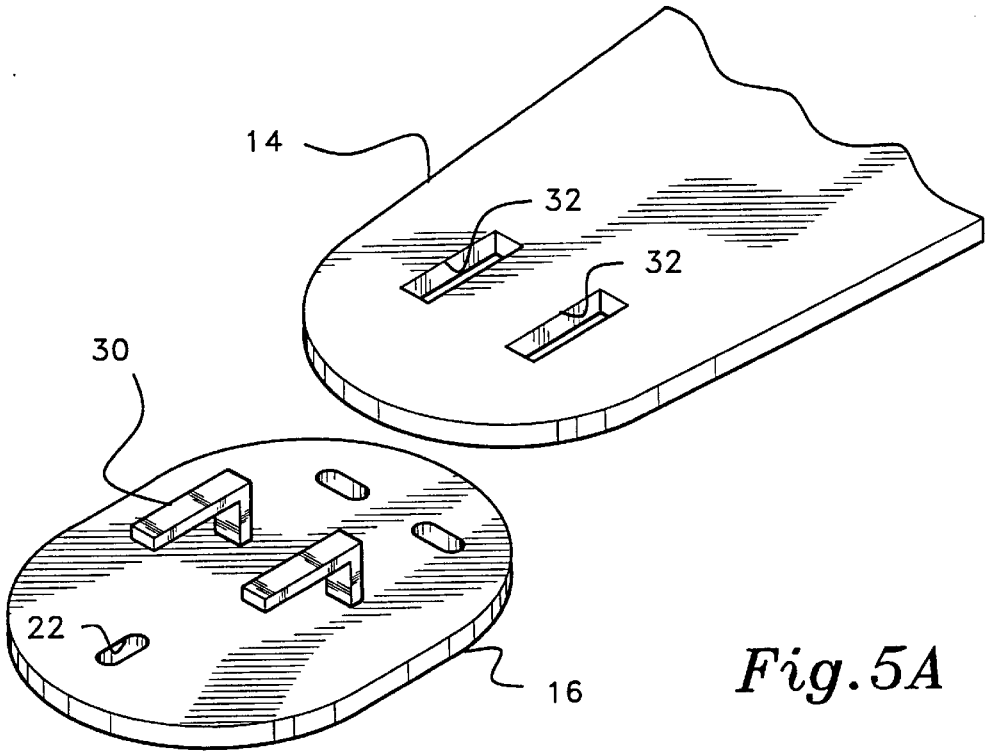
FIG. 5A is a perspective view of an adapter having a first attachment, fan blade to the adapter.

FIG. 5A shows alternative structure for attaching the fan blade 14 to the adapter 16. A plurality of securing apertures 32 are present on the proximal end of the blade 14, and a complimentary plurality of right-angled hooks 30 are affixed to the upper surface of the adapter. To removably secure the fan blade 14 to the adapter 16, the securing apertures 32 are first aligned in registry with and inserted over the right-angle hooks 30. The fan blade 14 is then pulled outwardly away from the adapter 16, thereby securing the blade in place. Centrifugal force of the rotating fan 12 maintains the blade 14 in this secured position.

Figure 5B:
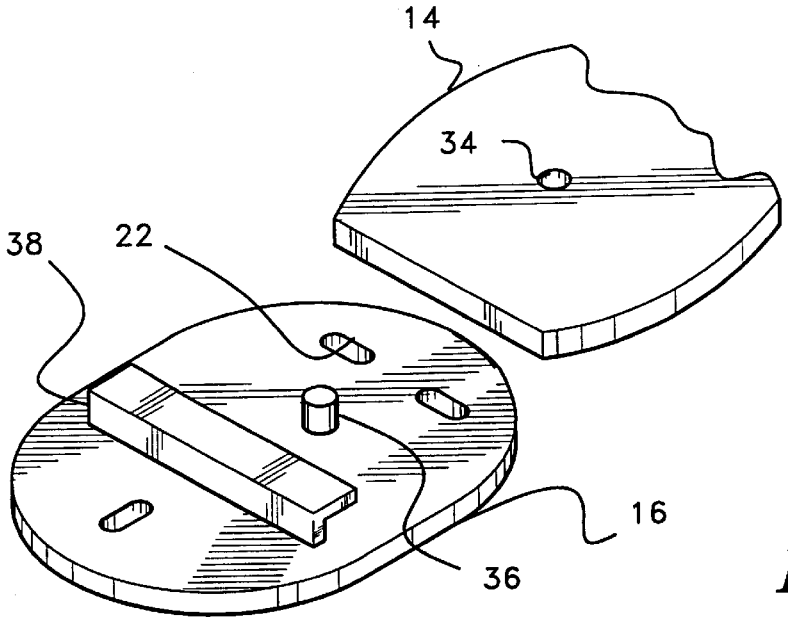
FIG. 5B is a perspective view of an adapter having second alternative attachment, fan blade to the adapter.

FIG. 5B represents a second structure for attaching the fan blade 14 to the adapter 16. A locator aperture 34 is present on the proximal end of the blade 14, and a complimentary locator pin 36 and a hold-down 38 are integral with or otherwise connected to the upper surface of the adapter. Additionally, the proximal end of the blade 14 is planar, which allows the proximal end to fit under and against the hold-down 38. To removably secure the fan blade 14 to the adapter 16, the proximal end of the blade is inserted under and against the hold down 38, and the locator aperture 34 is aligned in registry with and inserted over the locator pin 38, thereby securing the blade in place.

Figure 5C:
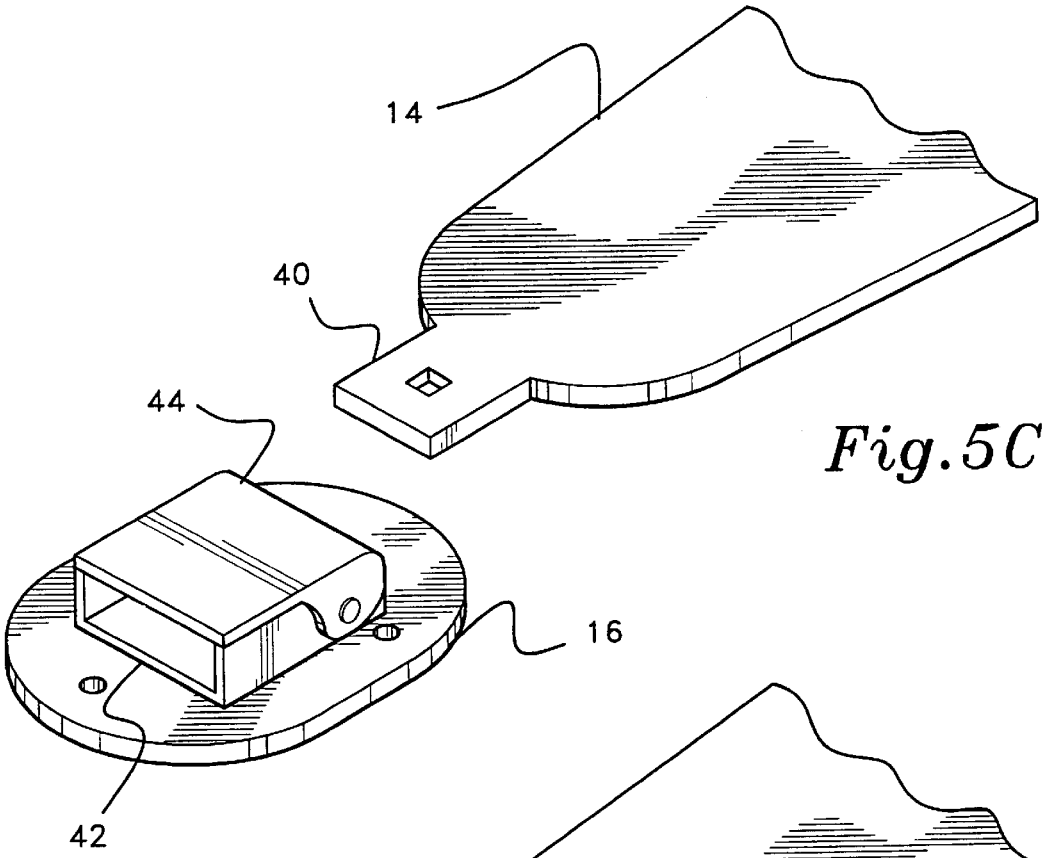
FIG. 5C is a perspective view of an adapter having third alternative attachment, fan blade to the adapter.

FIG. 5C represents a third structure for attaching the fan blade 14 to the adapter 16. A locking tab 40 is present on the proximal end of the blade 14, and a buckle 42, similar to a safety-belt buckle, is affixed to the upper surface of the adapter 16. To removably secure the fan blade 14 to the adapter 16, the tab 40 is inserted into the buckle. To remove the blade 14 from the buckle 42, a release member 44 is lifted, releasing the tab 40 from the buckle.

Figure 5D:
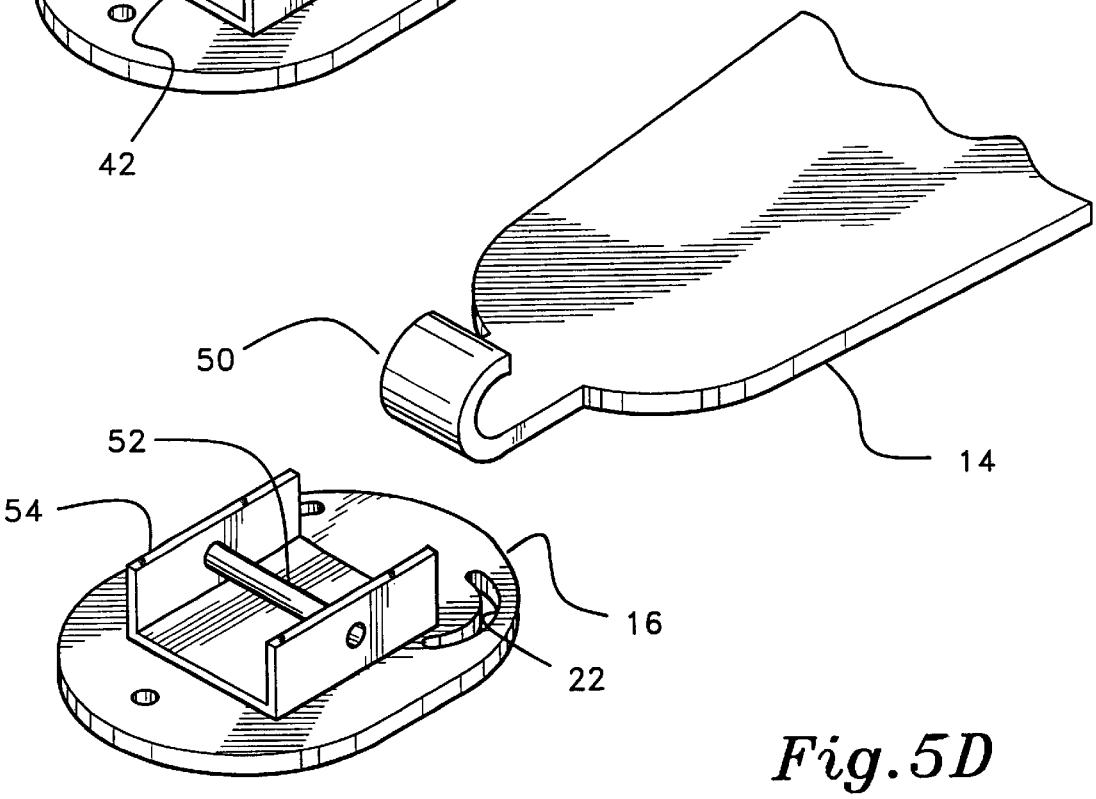
FIG. 5D is a perspective view of an adapter having fourth alternative attachment, fan blade to the adapter.

FIG. 5D represents a fourth structure for attaching the fan blade 14 to the adapter 16. A hook arm 50 is present on the proximal end of the blade 14, and a retaining bar 52 suspended by a mounting bracket 38 is affixed to the upper surface of the adapter 16. To removably secure the fan blade 14 to the adapter 16, the hook arm 50 is inserted around the retaining bar 52, thereby securing the blade in place. The mounting bracket 54 prevents lateral displacement of the blade 14, and centrifugal force of the rotating fan 12 prevents axial displacement of the blade 14.

Figure 5E:
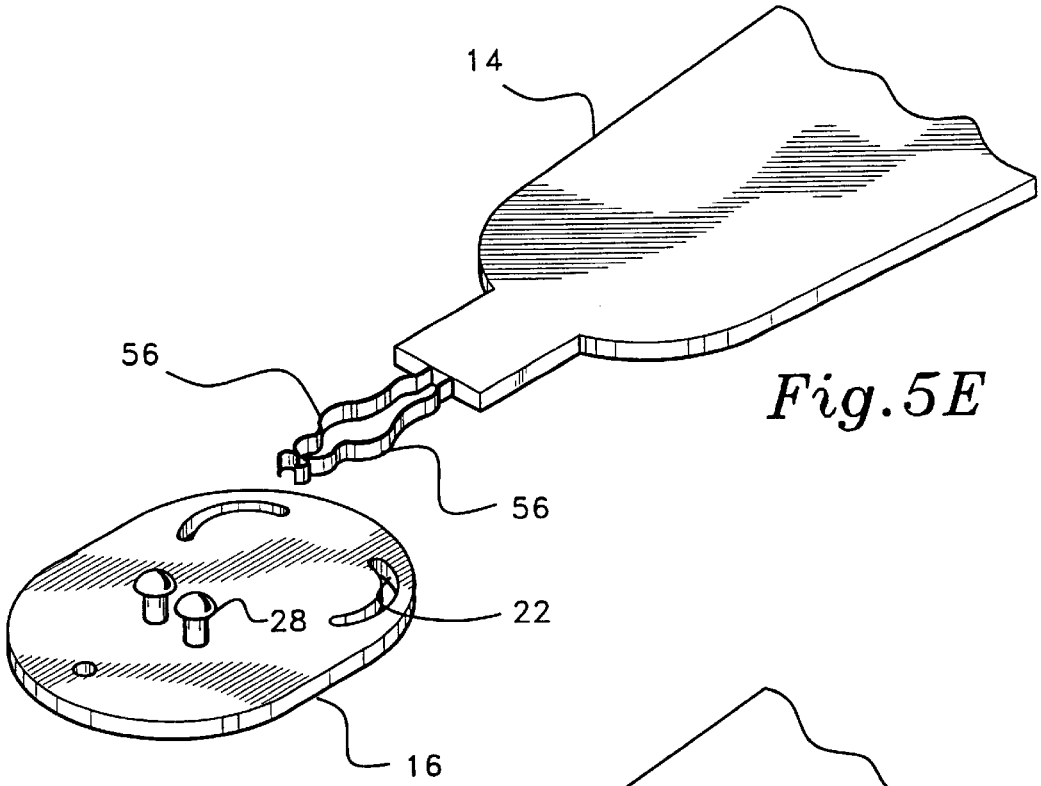
FIG. 5E is a perspective view of an adapter having fifth alternative attachment, fan blade to the adapter.

FIG. 5E represents a fifth structure for attaching the fan blade 14 to the adapter 16. A pair of spring clips 56 are present on the proximal end of the blade, and a pair of shoulder screws 28 are affixed to the upper surface of the adapter 16. To removably secure the fan blade 14 to the adapter 16, the spring clips 56 are pressed together and inserted intermediate the pair of shoulder screws 28. Upon insertion, the spring clips 56 are released to expand outward against the shoulder screws 28, thereby securing the, blade 14 in place.

Figure 5F:
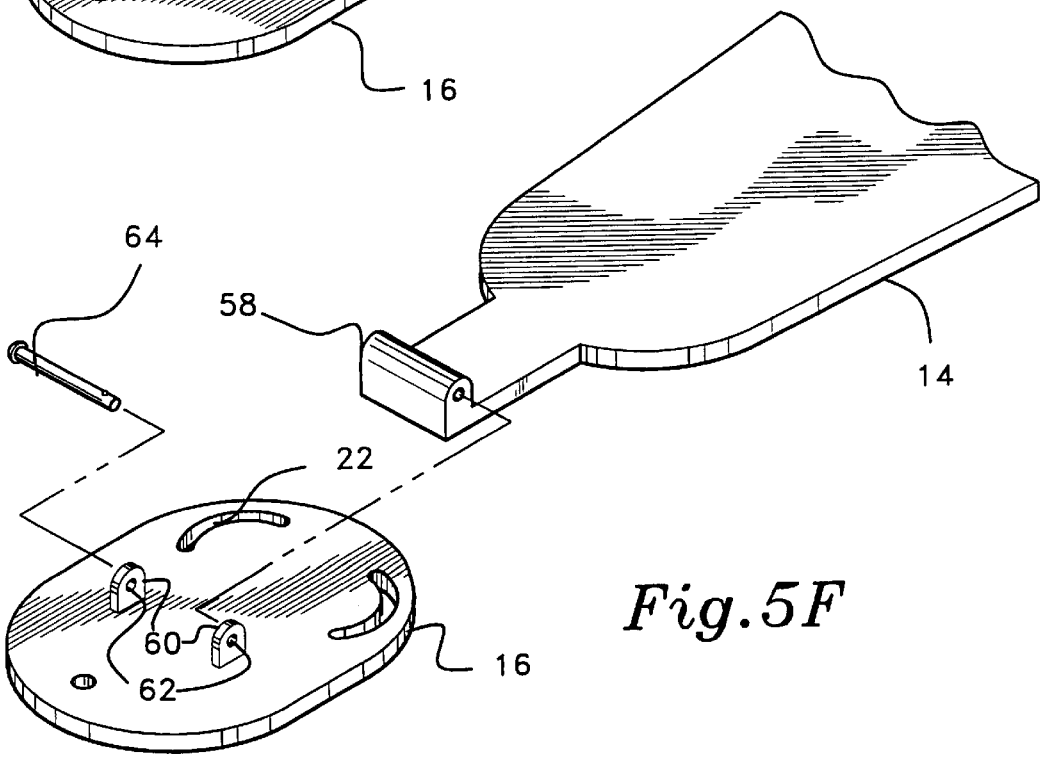
FIG. 5F is a perspective view of an adapter having sixth alternative attachment, fan blade to the adapter.

FIG. 5F represents a sixth structure for attaching the fan blade 14 to the adapter 16. A pin-receiving cylinder 58 is present on the proximal end of the blade, and a pair of securing tabs 60, each having a pin-receiving aperture 62 is affixed to the upper surface of the adapter 16. To removably secure the fan blade 14 to the adapter 16, the cylinder 58 is aligned in registry with the securing tabs 60 and a spring-loaded locking pin 64 is inserted through the pin-receiving apertures 62 and the cylinder, thereby securing the blade 14 in place.

Figure 5G:
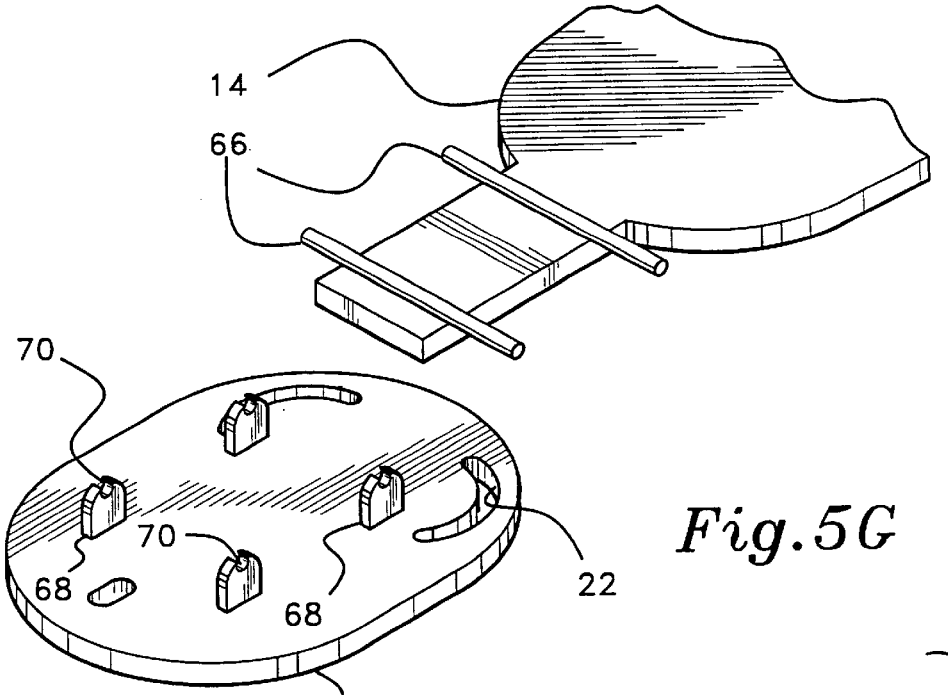
FIG. 5G is a perspective view of an adapter having seventh alternative attachment, fan blade to the adapter.

FIG. 5G represents a seventh structure for attaching the fan blade 14 to the adapter 16. A pair of locking extensions 66 is present on the proximal end of the blade and complimentary pairs of locking tabs 68, each having a mating recess 70, are affixed to the upper surface of the adapter 16. The recesses 70 are configured to receive the locking extensions 66 with a snap-fit, which allows the locking extensions to be repeatedly removed from and inserted into the recesses. To removably secure the fan blade 14 to the adapter 16, the locking extensions 66 are inserted into the mating recesses 70 of a pair of locking tabs 68, thereby securing the blade 14 in place.

Figure 6:
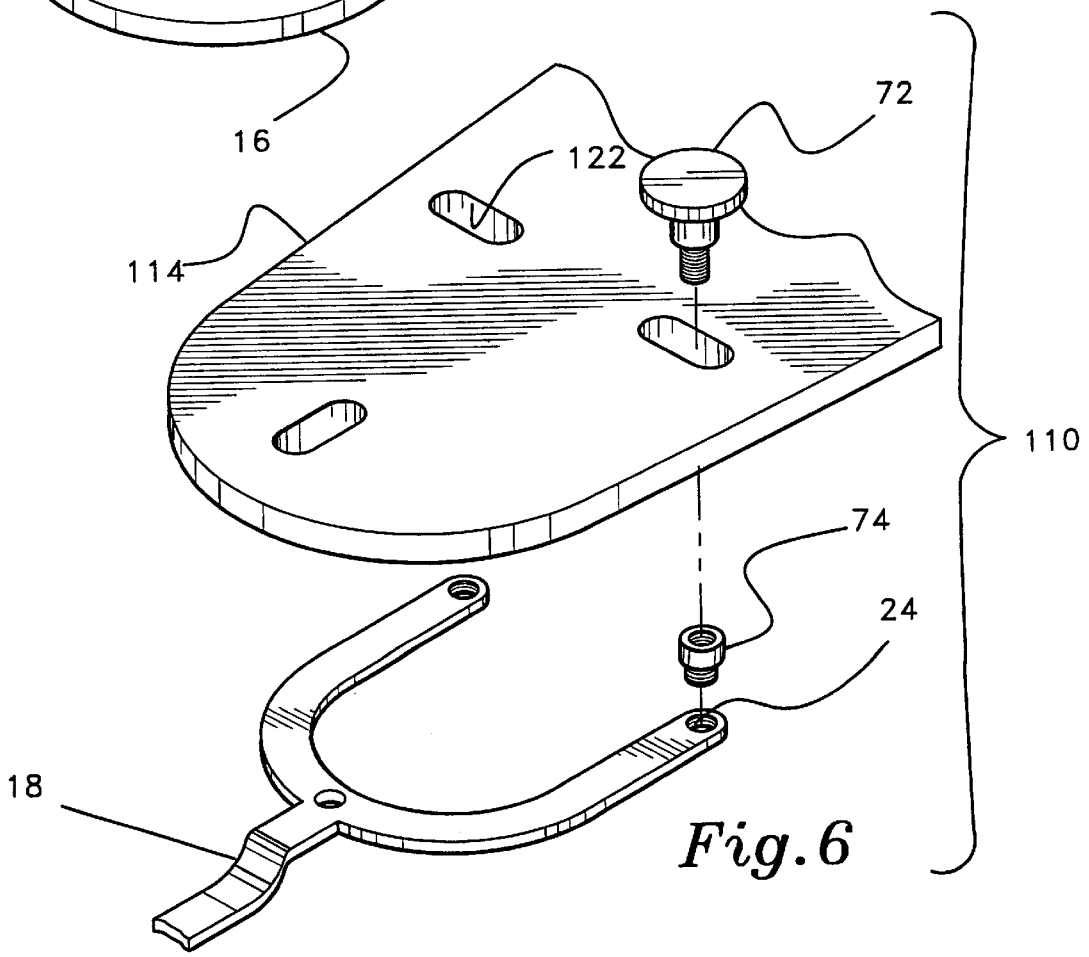
FIG. 6 is a perspective view of a second embodiment of the interchangeable fan blade system.
Figure 7A:
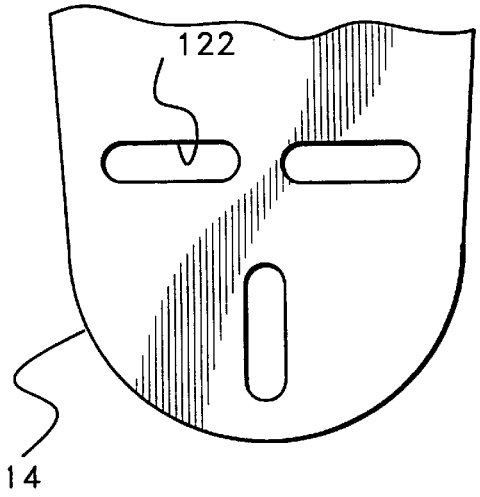
FIG. 7A is a partial plan view of a far blade having a first arrangement of attachment apertures.
Figure 7B:
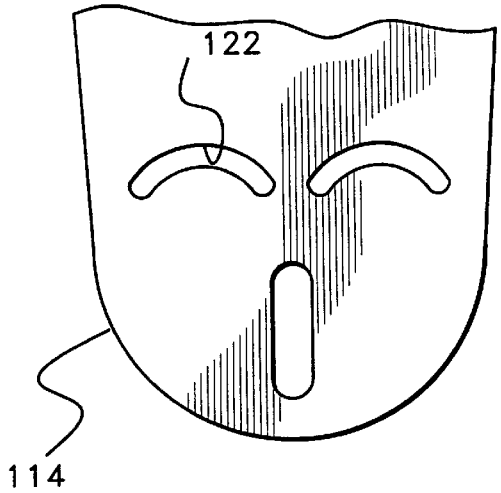
FIG. 7B is a partial plan view of a fan blade having a second arrangement of attachment apertures.
Figure 7C:
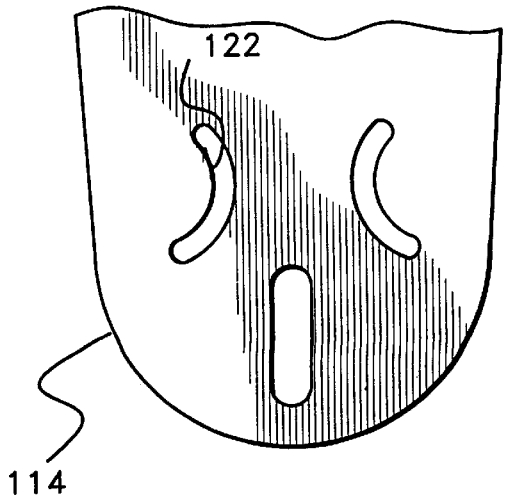
FIG. 7C is a partial plan view of a fan blade having a third arrangement of attachment apertures.

FIG. 6 represents a second embodiment of the interchangeable fan blade system 110. The system 110 comprises a fan blade 114 having a series of elongated attachment apertures 122 that align with the threaded cavities 24 of the support arm 18. The elongated attachment apertures 122 enable the blade 114 to fit virtually any fan support arm 18. To removably install the second embodiment of the interchangeable fan blade system 110, a knurled-knob screw 72 is inserted through the attachment aperture 122, and a male-female connector 74 is then threaded onto the knurled-knob screw. The male-female connector 74 with the knurled-knob screw 72 threaded therein is then threadably fitted into the threaded cavities of the support arm 18. FIGS. 7A, 7B and 7C illustrate alternative configurations of fan blade attachment apertures 122.

Figure 8A:
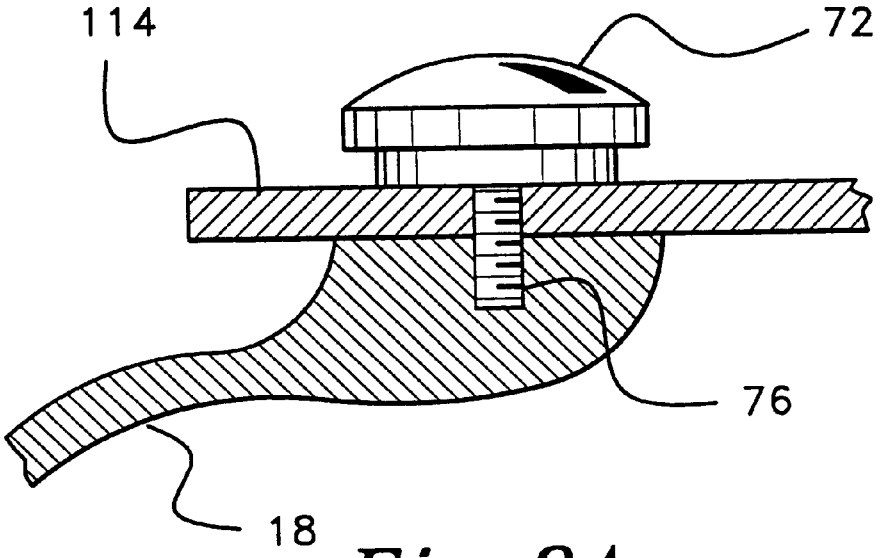
FIG. 8A is an enlarged scale, partial cross-sectional view of fan blade and fan support arm showing a fastener, fan blade to the fan support arm.

FIG. 8A shows an alternative structure for removably attaching the fan blade 114 to the support arm 18. A knurled-knob screw 72 with an elongated threaded portion 76 is threadably fitted to the threaded cavities of the support arm 18, thereby eliminating the need for a male-female connector 74. The knurled-knob screw 72 secures the fan blade 114 in place.

Figure 8B:
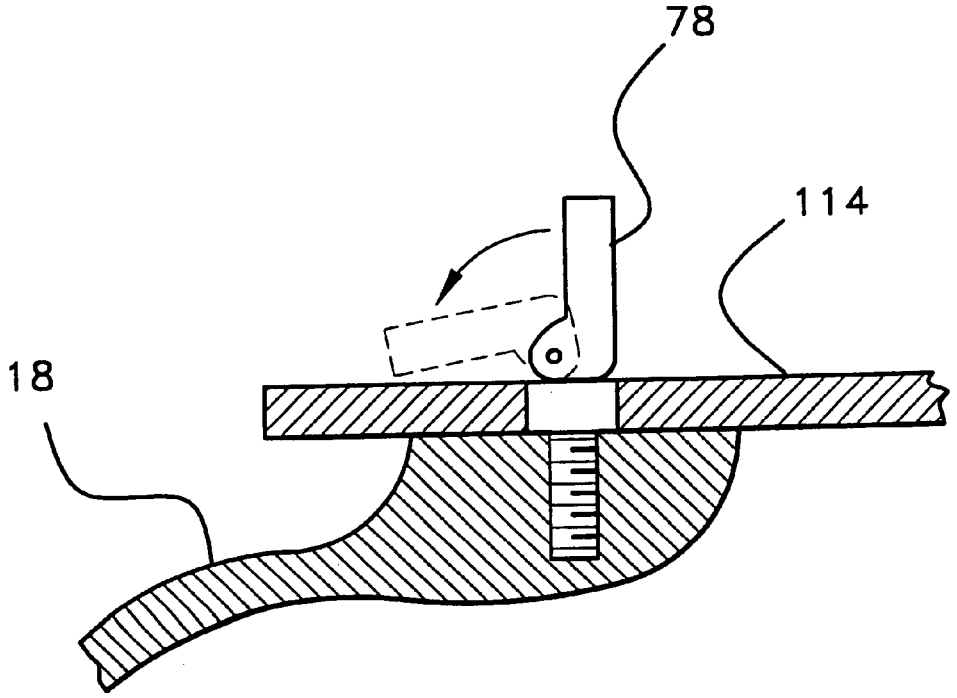
FIG. 8B is an enlarged scale, partial cross-sectional view of fan blade and fan support arm showing another fastener for attaching the fan blade to the fan support arm.

FIG. 8B discloses a second structure for removably attaching the fan blade 114 to the support arm 18. An overcenter, spring-clamp screw 78 is threadably fitted to the threaded cavities of the support arm 18. The fan blade 114 is then secured in place by folding the spring clamp down over the blade 114.

Figure 9:
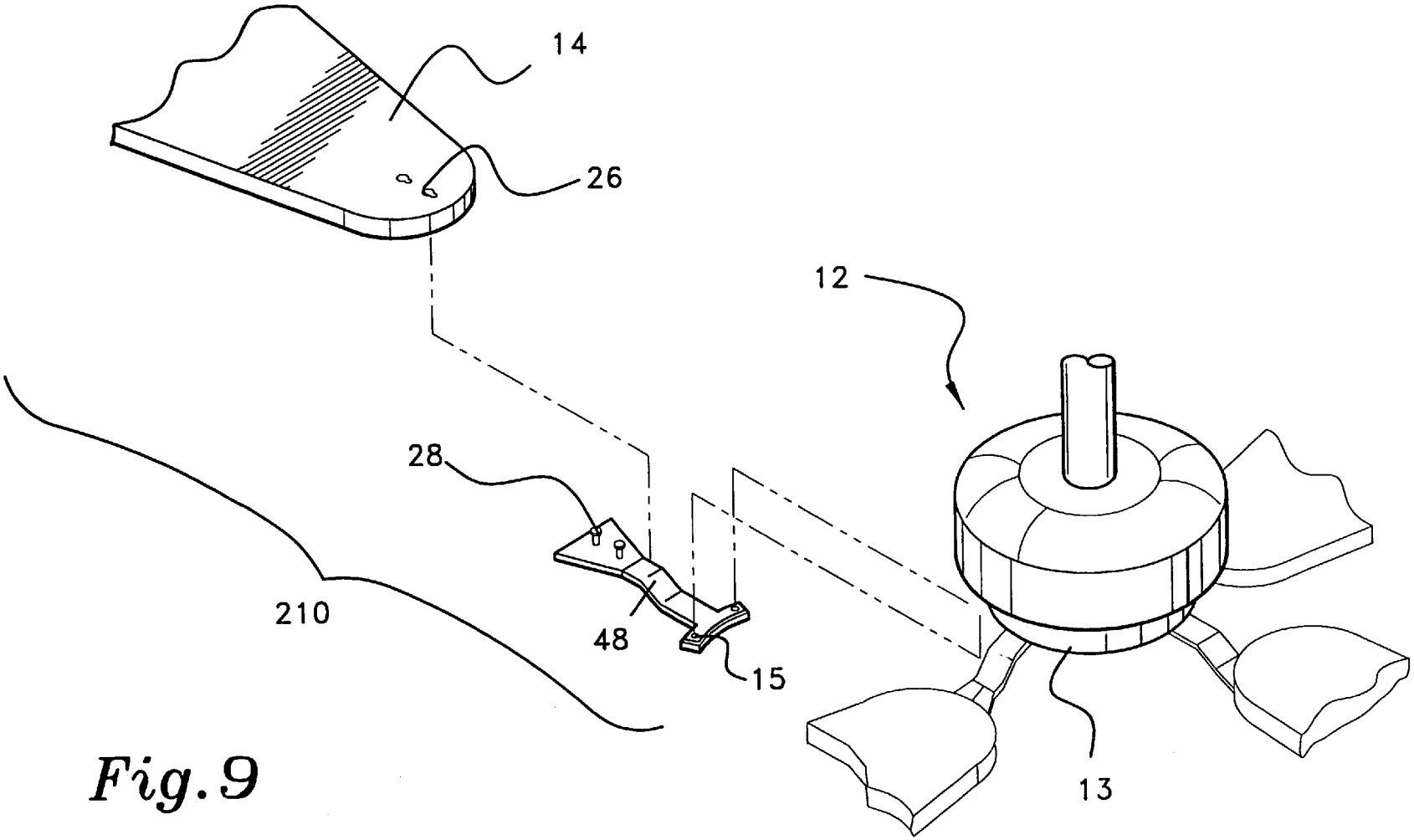
FIG. 9 is a perspective view of a third embodiment of the interchangeable fan blade system.

FIG. 9 represents a third embodiment of the interchangeable fan blade system 210. The system 210 includes a fan blade 14 and a support arm 48 adapted to receive the fan blade. A plurality of keyhole bores are present on the proximal end of the blade 14, and a complimentary plurality of shoulder screws 28 are affixed to the upper surface of the distal end of the support arm 48. The support arm has a distal end having a plurality of threaded cavities 15 for threaded attachment to the rotary portion 13 of a fan 12.

To removably secure the fan blade 14 to the support arm 48, the keyhole bores 26 are first aligned in registry with and inserted over the shoulder screws 28. The fan blade 14 is then pulled distally away from the support arm 48, thereby securing the blade in place. Centrifugal force of the rotating fan 12 maintains the blade 14 in this secured position. The structure for securing the fan blade 14 to the support arm shown in FIG. 9 is about the same as that for securing the fan blade 14 to the adapter 16 shown in FIGS. 2–3. The fasteners for securing the fan blade 14 to the support arm may be chosen from the variety as shown in FIGS. 5A–5G, namely: hooks, locator pin and hold downs, snap buckles, hook arms, spring clips, quick release pins and snap-ins.

Additionally, the fasteners for removably attaching a fan blade to a respective adapter or support arm may include hook-and-loop fasteners, snap buttons, cotter pins, drive pins, magnets, dovetails, screws, clevis pins, keyways, cogs, bolts, retaining rings, straps, buckles, tape, chains, zippers, wires, twist locks, twist ties, chucks, clamps, pinchers, cranks, vacuum seals, S-hooks, slip hooks, studs and shanks.

It is to be understood that the present invention is not limited to the embodiments described above, but encompasses any and all embodiments within the scope of the following claims.

I claim:

1. An interchangeable fan blade system comprising:

at least one support arm having a plurality of internally threaded cavities;

at least one interchangeable fan blade having a proximal end and a distal end, the proximal end having a plurality of elongated apertures aligned with the threaded cavities of said support arm;

a male-female connector threadably fitted into each of said threaded cavities; and a knurled-knob screw inserted through each of the apertures of said fan blade and threadably secured to said male-female connector for removably securing said interchangeable fan blade to said support arm without the use of tools.

2. An interchangeable fan blade system comprising:

at least one support arm having a plurality of internally threaded cavities;

at least one interchangeable fan blade having a proximal end and a distal end, the proximal end having a plurality of elongated apertures aligned with the threaded cavities of said support arm; and a knurled-knob screw inserted through each of the apertures of said fan blade and threadably secured to each of said threaded cavities for removably securing said interchangeable fan blade to said support arm without the use of tools.

3. An interchangeable fan blade system comprising:

at least one support arm having a plurality of internally threaded cavities;

at least one interchangeable fan blade having a proximal end and a distal end, the proximal end having a plurality of elongated apertures aligned with the threaded cavities of said support arm; and a spring-clamp screw inserted through each of the apertures of said fan blade and threadably secured to each of said threaded cavities for removably securing said interchangeable fan blade to said support arm without the use of tools.

* * * * *